US007874696B2

(12) United States Patent
Engel

(10) Patent No.: US 7,874,696 B2
(45) Date of Patent: Jan. 25, 2011

(54) WALL LUMINAIRE

(76) Inventor: Hartmut S. Engel, Monrepos Strasse 7, Ludwigsburg (DE) 71634

( * ) Notice: Subject to any disclaimer, the term of this patent is extended or adjusted under 35 U.S.C. 154(b) by 212 days.

(21) Appl. No.: 12/184,699

(22) Filed: Aug. 1, 2008

(65) Prior Publication Data

US 2009/0034242 A1 Feb. 5, 2009

(30) Foreign Application Priority Data

Aug. 2, 2007 (EP) ..... 07015212

(51) Int. Cl.
*F21V 21/00* (2006.01)

(52) U.S. Cl. ..... 362/147; 362/249.02; 362/368; 362/374; 362/375

(58) Field of Classification Search ..... 362/145, 362/147, 368, 370, 374, 375, 612, 614, 632, 362/633, 634, 812, 249.02
See application file for complete search history.

(56) References Cited

U.S. PATENT DOCUMENTS 5,278,738 A * 1/1994 Illes ..... 362/147
5,379,199 A * 1/1995 Hirshenhorn et al. ..... 362/147
5,546,292 A * 8/1996 Shemitz ..... 362/234
6,652,113 B2 * 11/2003 Tant ..... 362/147
7,097,319 B2 * 8/2006 Mauk et al. ..... 362/147

FOREIGN PATENT DOCUMENTS

FR 2 884 593 A1 10/2006
GB 2 419 935 A 5/2006

* cited by examiner

*Primary Examiner*—Thomas M Sember
(74) *Attorney, Agent, or Firm*—Townsend and Townsend and Crew, LLP

(57) ABSTRACT

A wall luminaire is described having a housing intended for the reception of the electrical components and having at least one light permeable element mounted to the housing whose special feature consists of the fact that light generated by a plurality of LEDs with an associated optical system or by a fluorescent lamp arrangement is guided in bundled form between two surfaces which are disposed in the sidelight region of the light beam.

24 Claims, 7 Drawing Sheets

WALL LUMINAIRE

CROSS-REFERENCE TO RELATED APPLICATIONS

This application claims priority to European Application No. 07 015 212.9, filed Aug. 2, 2007, the disclosure of which is herein incorporated by reference.

BACKGROUND OF THE INVENTION

The invention relates to a wall luminaire having a housing intended for the reception of the electrical components and having at least one light permeable element mounted at the housing.

SUMMARY OF THE INVENTION

It is an object of the present invention to provide a wall luminaire intended for equipping with LEDs or with compact fluorescent lamps which produces a multifunction with respect to the light radiation which can be achieved and in particular with respect to regions to be illuminated differently with a simple construction structure.

This object is substantially satisfied in accordance with the invention for a use as a surface mounted luminaire in that the housing has the shape of a parallelepiped, in particular a shallow parallelepiped, with a rectangular top wall and base wall and preferably square end-face walls; in that at least one light exit opening is provided, in particular disposed centrally, in the top wall or base wall and a planar lighting surface associated with the front side of the housing and extending parallel to the front wall of the housing is provided which is made of opal glass or of a light-effective plastic material; and in that a plurality of LED elements are arranged in the inner space of the housing as a light source on at least one carrier surface such that a directed light beam is generated between the wall and the lighting surface which causes a regional illumination at the top and/or base side, on the one hand, and, starting from the respective light exit opening, expands, on the other hand, such that each lighting surface is disposed in the sidelight region of the light beam.

A laterally and upwardly open light direction space and reflection space is provided by the planar, light permeable lighting surface associated with the front side of the housing, between this lighting surface and the wall, through which direction space and reflection space the focused light bundle exiting the housing is guided, with the opening angle of the light beam being selected such that the lighting surface and the wall oppositely disposed to it are disposed in the sidelight region of the light beam and thus light reflected or scattered at the wall is additionally utilized for the areal brightening of the lighting surface.

In addition to a desired accentuation of the wall or facade, a scattered light surface appearing clearly due to the light intensity achieved is provided by the illumination with sidelight and the resulting light reflections, while the bundled light beam, provided it is directed upwardly, causes a ceiling brightening and, if it is directly downwardly, results, for example, in making a road clearly visible. The corresponding design of the respective ideal light beam can be achieved by selection of the optical focusing system associated with the LEDs. It is equally possible without problem to preset a respective desired monochromatic light color by selection of the LEDs.

It is advantageous for specific applications to be able to preset the main direction of the generated light beam in a specific angular range and, for this purpose, the carrier surface for the LED elements is supported adjustably and/or pivotably, with the optical focusing system taking part in the adjustment or pivot movement.

If a plurality of light exit openings are provided next to one another in the elongated housing, the carrier surfaces associated with these different light exit openings are preferably made adjustable independently of one another so that the respective required total beam can be formed from individual beam bundles.

In accordance with a specific embodiment, at least one light exit opening with associated light source corresponding to a light exit opening at the top wall side is provided in the base wall of the housing. This embodiment variant is in particular suitable for those cases in which a pronounced illumination of the base region is desired in addition to the soft light emission achieved via the lighting surface. In this case, the main axes of the upwardly directed light beam and of the downwardly directed light beam can be selected differently.

The width of each lighting surface is selected to be equal to the longitudinal extent of the housing for the purpose of achieving a high quality esthetic aspect, and the housing or a corresponding top housing wall forms a clearly accentuated boundary of the illuminated light permeable visible surface.

A lighting surface, and in particular a reflection surface, can also be provided fixed to the housing at the wall side disposed opposite the front lighting surface.

In accordance with a preferred aspect of the invention, the housing includes a base plate for the mounting of all the functional components, a section part essentially U-shaped in cross-section with at least one light exit opening provided in a free limb and an outwardly disposed mounting surface at the base part of the U section for a lighting surface, as well as lateral support wall parts.

The respective surface carrying the LED elements with the associated optical system is fastened to the base plate via a mount preferably shaped from stamped sheet metal parts, with the carrier surfaces for the LEDs with their associated optical system being screwed to the mount in a manner adjustable in inclination.

For the creation of an outwardly sealed parallelepiped in which the functional elements are located, the base plate, the section part and the lateral support wall parts are screwed to one another with the interposition of a seal which is in particular made in one part.

It is possible by this multipart design to combine the total luminaire to form two main units, namely to form a first main unit with the base plate carrying all the functional components and made for wall mounting, on the one hand, and to form a second main unit which can be screwed to the base plate via the lateral cover parts and which also carries the respective lighting surface. After the joining together of the two main units, lateral masking caps are attached via suitable snap-latch connections for the completion of the luminaire.

For a use as a built-in lamp, the set object in accordance with the invention is substantially satisfied in that the housing is made as a rectangular built-in pot, in particular with an outwardly disposed abutment flange; in that a light conducting wall is provided in the housing which extends over the width of the housing and extends from a rear wall side region, in particular a corner region, to the front housing end or abutment flange disposed diagonally opposite the corner region; in that a lighting surface is provided parallel to and spaced apart from the light conducting wall, the lighting surface being made of opal glass or of a corresponding material, being in particular planar and extending approximately up to the opening plane of the housing; and in that there is provided in the rear side upper corner region of the housing a light source which preferably extends over the width of the housing and which generates a directed band-shaped light beam between the light conducting wall and the lighting surface, with both the light conducting wall and the lighting surface being disposed in the sidelight region of the outwardly expanding light beam.

On the one hand, a light guidance space for the light beam which is focused, which exits the luminaire and which illuminates a region close to the luminaire or a corresponding traffic area is provided between the light conducting wall and the lighting surface by this aspect, and, on the other hand, a uniform illumination of the light conducting wall and a brightening of the lighting surface associated with it is achieved by the utilization of the sidelight. Glare-free useful light is thus obtained in the region close to the luminaire and beneath the luminaire, and esthetically appealing diffuse light is obtained in the frontal region directly in front of the luminaire. Desired color differences can also be obtained by a corresponding design of the light conducting surface and the lighting surface, with the general lighting color being able to be preset by selection of the corresponding LEDs.

Instead of a plurality of LEDs, a fluorescent lamp arrangement, in particular a multi-rod compact fluorescent lamp, can also be used for the generation of a band-shaped light beam between the light conducting wall and the lighting surface.

An embodiment of the invention is of particular advantage in which the individual components of the total structure are combined to form two assemblies which can be pushed into one another and can in particular be sealingly coupled with one another.

The one assembly is formed by a housing to whose rear wall a mounting plate, in particular a metal mounting plate, is attached for the mounting of the light source and in particular also for the mounting of all the further electrical or electronic functional components. This fastening plate is designed such that the light source is disposed in the upper rear corner region of the housing, with the mounting plate in particular including an upper angled region which extends approximately parallel to the upper boundary wall of the housing, engages over the light source and extends so far to the front that it can also act as a reflector surface.

The assembly which can be pushed into the housing includes all the components conducting and guiding the light and is also made as a closed unit which has a glass cover at the front side and which has a light permeable plate which is disposed opposite the light source mounted in the housing and through which the light coming from the light source enters into the region between the light conducting wall and the lighting surface and in particular illuminates these surfaces with scattered light.

Hook elements are provided at the front side cover frame belonging to the assembly which can be pushed in and engage into associated housing slots in the inserted state of the assembly and, in the lower region of the cover frame, an eccentric or conical closure is provided which allows, in cooperation with the housing, the cover frame and thus the assembly which can be pushed in to be latched firmly with the housing, preferably with the interposition of a peripheral seal. This connection technique also ensures a simple separation of the two assemblies from one another, which can be required, for example, for the purpose of changing the light source.

An ideal inner space ventilation can also be achieved by this two-part embodiment with mutual sealing of the inner spaces of both assemblies with respect to one another, and an advantageous exchange of moisture can be ensured via corresponding housing openings.

Embodiments of the invention will be described in the following with respect to the drawing.

DESCRIPTION OF THE PREFERRED EMBODIMENTS

Figure 1:
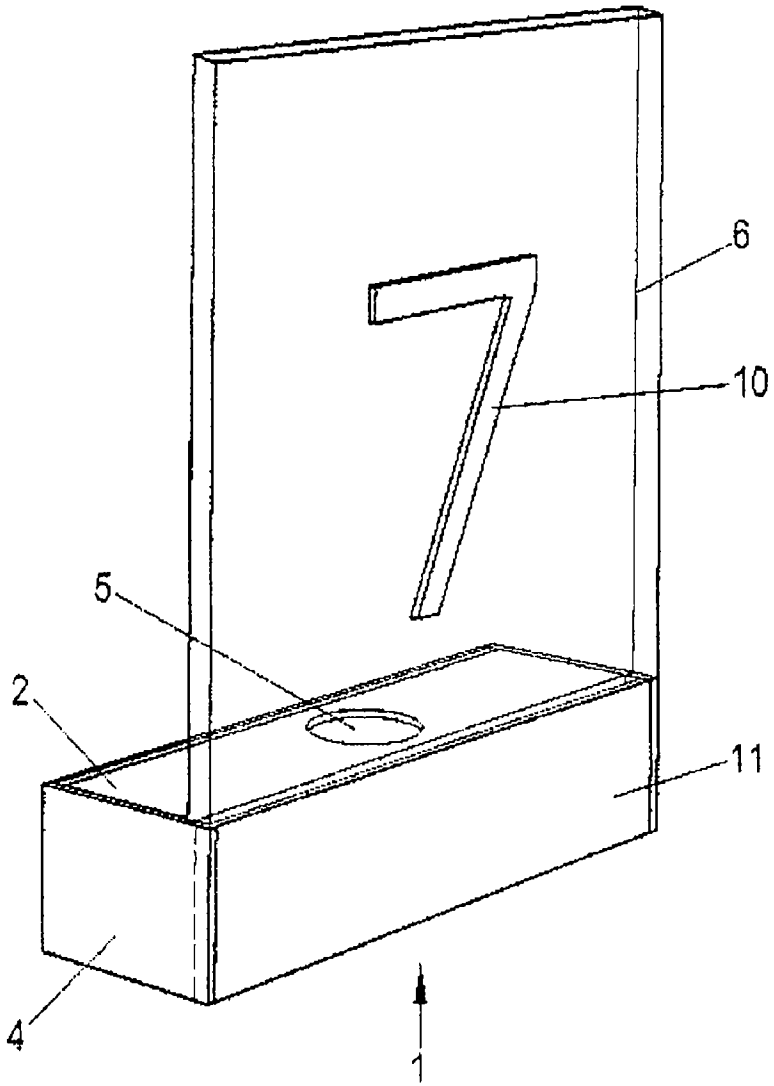
FIG. 1 is a schematically represented perspective oblique view of an embodiment of a luminaire in accordance with the invention.

FIG. 1 shows a parallelepiped shaped housing 1 having a rectangular upper top wall 2, a corresponding base wall as well as preferably approximately square end-face walls 4.

A rectangular lighting surface 6 made of light permeable and in particular scattering material is mounted at the front side to this housing and has a mark 10 such as a house number or a corresponding mark that can be integrated into it.

A circular light exit opening 5 is provided centrally in the top wall 2 of the housing 1 and a light source is located beneath it in the form of a plurality of LED elements with associated optical focusing systems attached to a carrier surface. This light source is designed such that a directed light beam exits the light exit opening 5 and its opening angle is selected such that the central beam substantially extends between the lighting surface 6 and the wall, but both the lighting surface 6 and the wall disposed opposite the lighting surface are disposed in the sidelight region of this beam, whereby the lighting surface 6 is lit by diffuse light.

Instead of an opal lighting surface 6, a lighting surface made up of multiple layers can also be used. Such a layer structure can comprise a plastic plate made as a prism surface at one side, with a thin glass cover plate being able to be provided at the prism side and a scattering foil being able to be provided at the rear side.

To further increase the reflection effect or scattering effect, which is already produced by the wall disposed opposite the lighting surface, a surface can be provided and mounted to the housing at the wall side whose dimensions are matched to the lighting surface 6, with this surface preferably being made reflective.

Instead of a single light exit opening at the upper side or at the lower side of the housing, with a corresponding extension of the housing, a plurality of light exit openings arranged next to one another can be used. In this case, the carrier surfaces associated with the LEDs are also individually associated with each light exit opening and their inclination can be set individually. In this manner, the shape of the total beam formed can be advantageously influenced.

Figure 2:
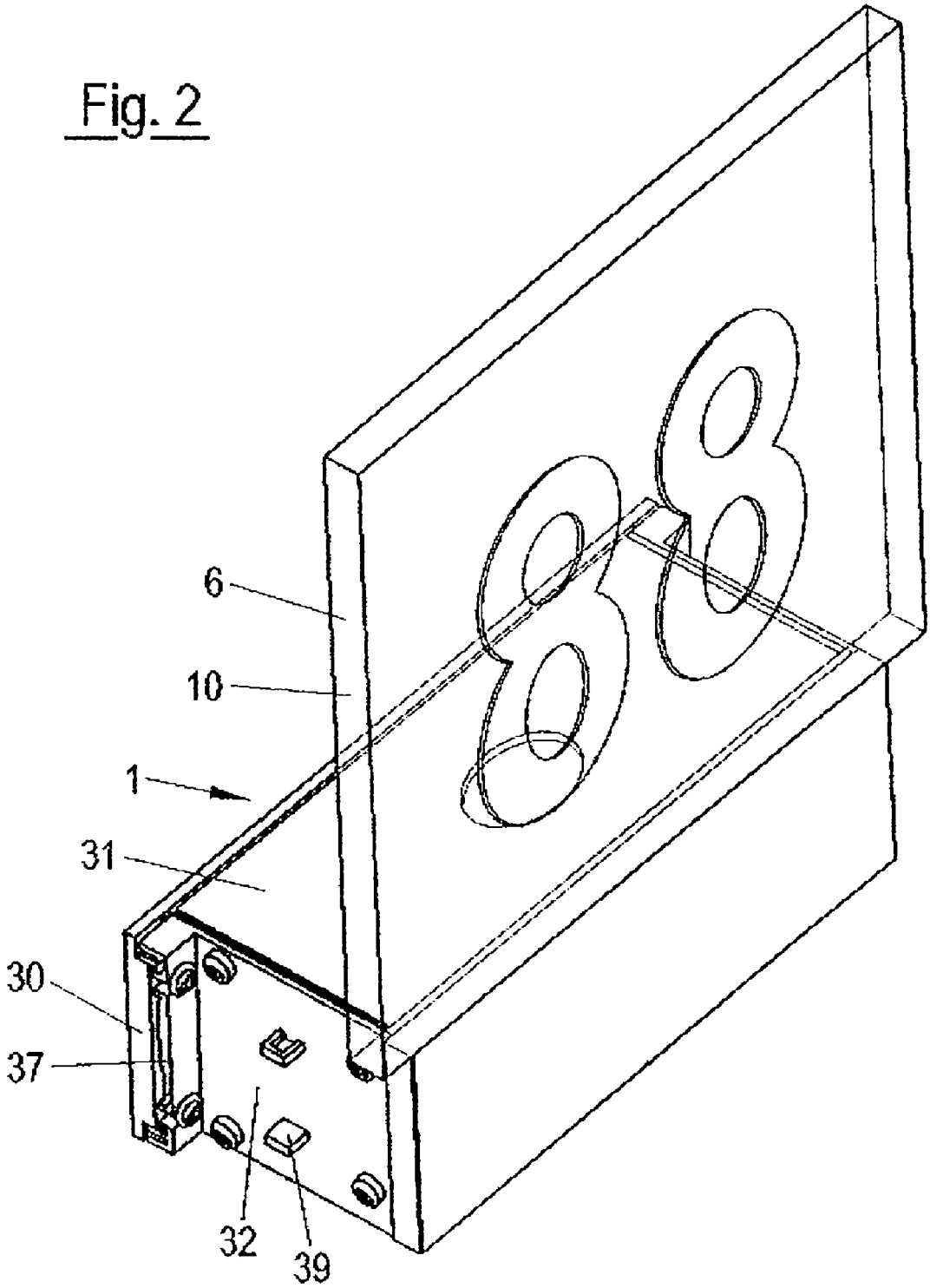
FIG. 2 is a perspective oblique view of a further aspect of the invention without lateral masking caps and without a visible surface covering of the mounting region of the lighting surface.

The perspective oblique view in accordance with FIG. 2 shows a preferred embodiment of a luminaire in accordance with the invention, with the lighting surface 6 illuminated by sidelight in this representation being provided with a house number representation 10 for the exemplary illustration of use options.

The housing 1 of the luminaire includes—as will still be explained in detail—a base plate 10 which is combined with a U-shaped section part 21 and lateral support wall parts 32 to form an outwardly sealed parallelepiped receiving the functional elements.

The lateral support wall parts 32 are connected to the U-section part 31 and have outwardly angled flange parts 37 via which the support wall parts 32, and thus also the U-section part 31 carrying the lighting surface 7, can be screwed to the base plate 30.

Figure 3:
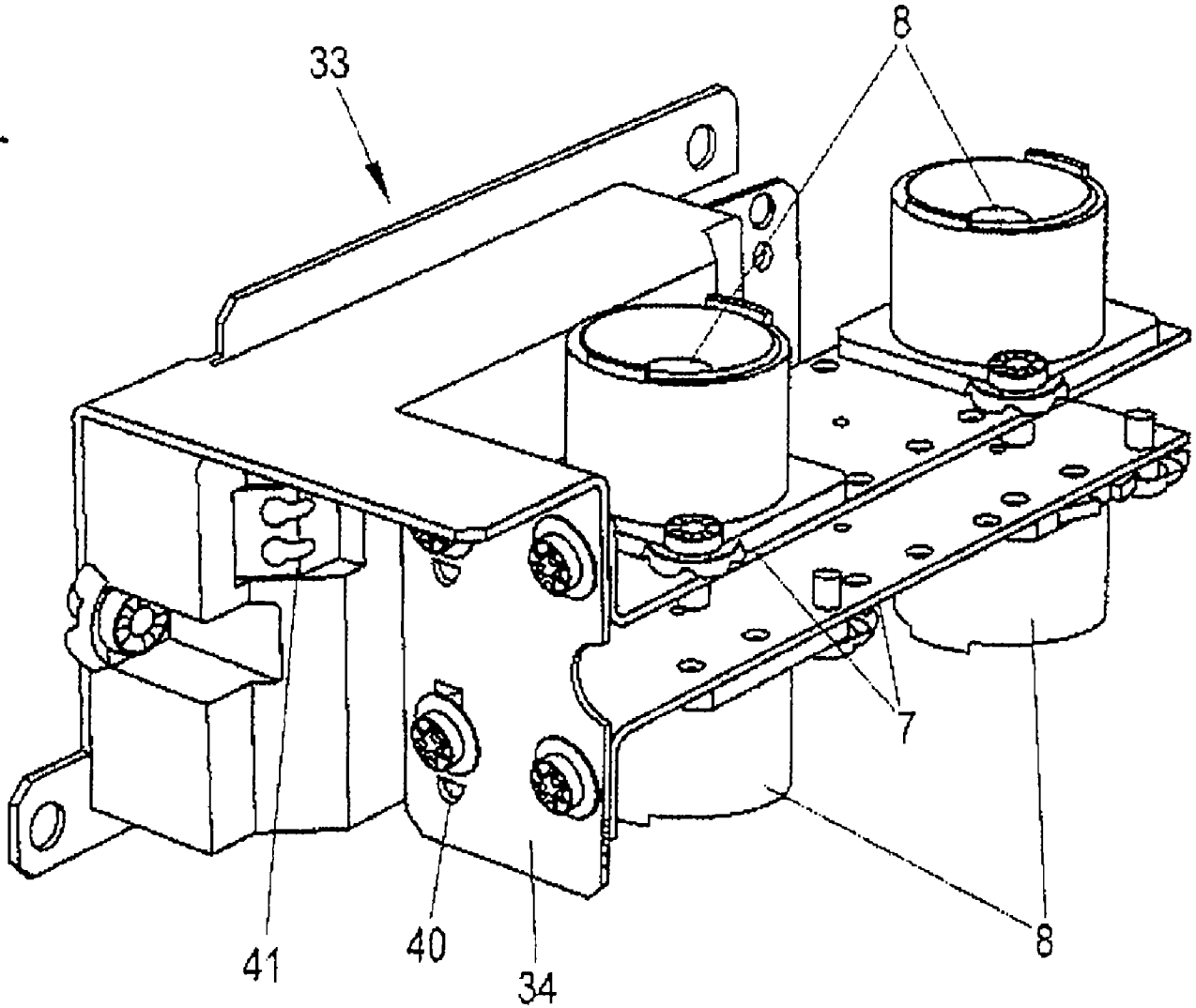
FIG. 3 is a detailed representation of an embodiment of a mount for the LED elements with associated optical system.

FIG. 3 shows an embodiment of a mount 33 for functional components, in particular for the LED elements 8 with associated optical system, the mount in particular being produced from stamped sheet metal parts. This mount 33 is fastened, in particular screwed, to the base plate 30.

In addition to the reception of optionally required electronic components in a housing part and the reception of connection terminals 41, this mount 33 above all permits an attachment of the LED elements 8 via the carrier surfaces 7 which is adjustable with respect to position and inclination. For this purpose, the respective carrier surface 7 is provided, on the one hand, with a plurality of fastening openings distributed over the surface for the fixing of the LED elements or their mounting and is connected, on the other hand, via an angled region to a holding hoop 34, and indeed via elongate hole openings or curved openings 40 which permit the respective desired adjustment of the inclinations of the carrier surfaces 7 after loosening the corresponding screws.

Figure 4:
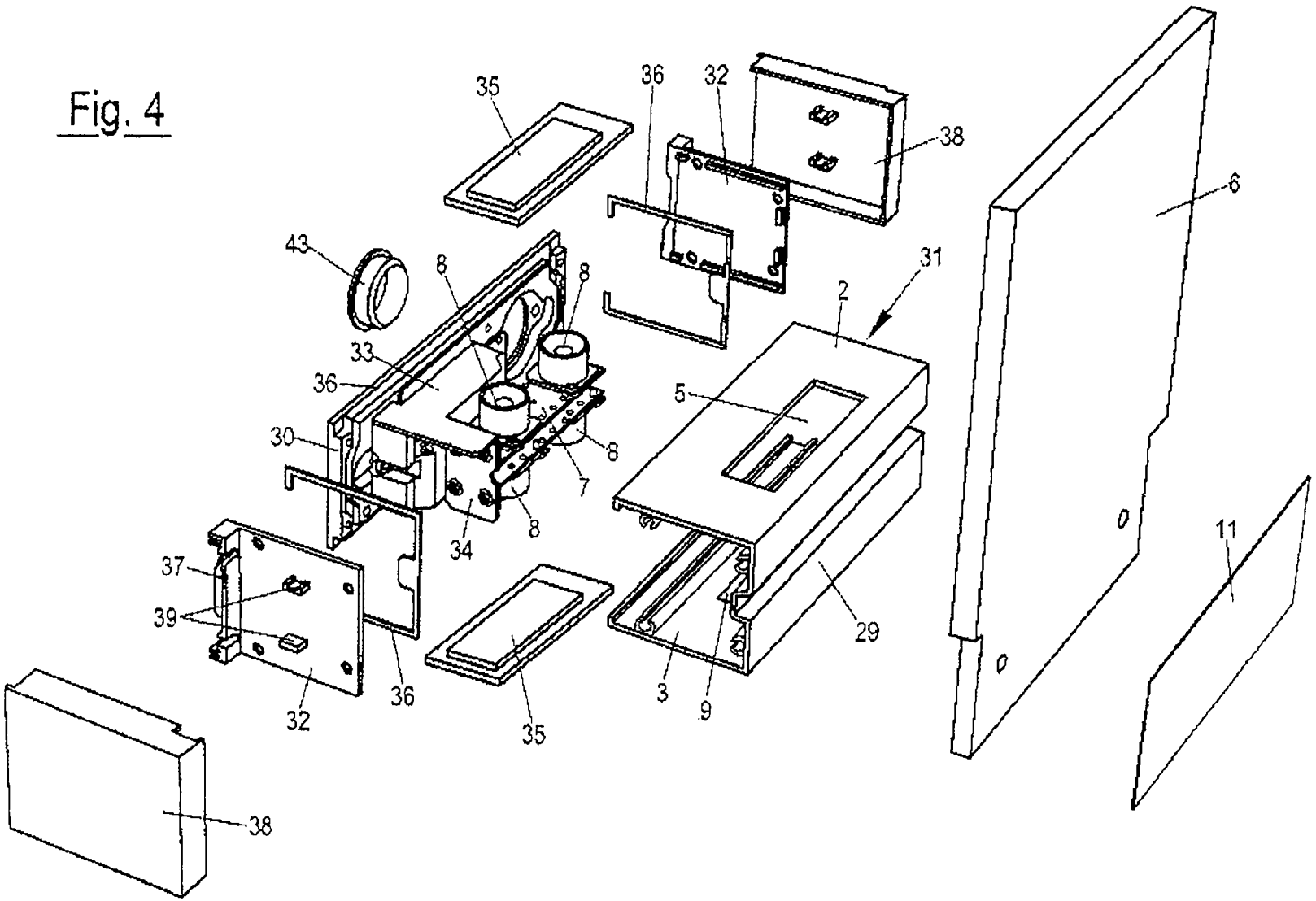
FIG. 4 is an exploded representation of a preferred embodiment of the invention using the mount in accordance with FIG. 3.

The exploded representation in accordance with FIG. 4 shows the total structure of a luminaire in accordance with FIG. 2.

The already explained base plate 30, which is provided with bores for a wall mounting, serves for the reception of the mount 33 for all functional components already explained with reference to FIG. 3. The base plate 30 is provided in the region of its upper and lower rims with sealing sections 36 which complement one another together with the approximately U-shaped further sealing sections 36 to form a total seal which is preferably made in one piece.

The U-section part 31, which is preferably an extruded part, has respective light exit openings 5 or 9 in its top wall 2 and its base wall 3 which can be sealingly closed by means of associated light permeable covers 35. The outwardly disposed surface of the base wall of the section part 31 represents a mounting surface 29 for the respective lighting surface 6, for which purpose a corresponding groove is provided in the section part for the reception of nuts which serve for the screw fastening of the lighting surface 6. The region of the lighting surface 6 serving for the mounting is covered by means of a visible surface 11.

The U-section part 31 can be screwed to lateral support wall parts 32, and indeed with the interposition of the seals 36. The lateral support wall parts 32 have outwardly angled flange parts 37 via which they can be screwed to the base plate 30. A sealing plug 43 is provided for the opening provided in the base plate for a line feed.

Two main components can be prepared by way of preassembly by the described design of the structure, namely a first main unit in the form of the base plate 21 carrying all the functional units and a second main unit which is formed by the U-section part 31 carrying the lighting surface 6 and having lateral support wall parts 32. The joining together of these two units with interposition of the seal 36 takes place by the screwing of the support wall parts 32 to the base plate 30, on which lateral masking caps 38 are fixed to the support wall parts 32 via latch elements 39 for the completion of the assembly.

Figure 5:
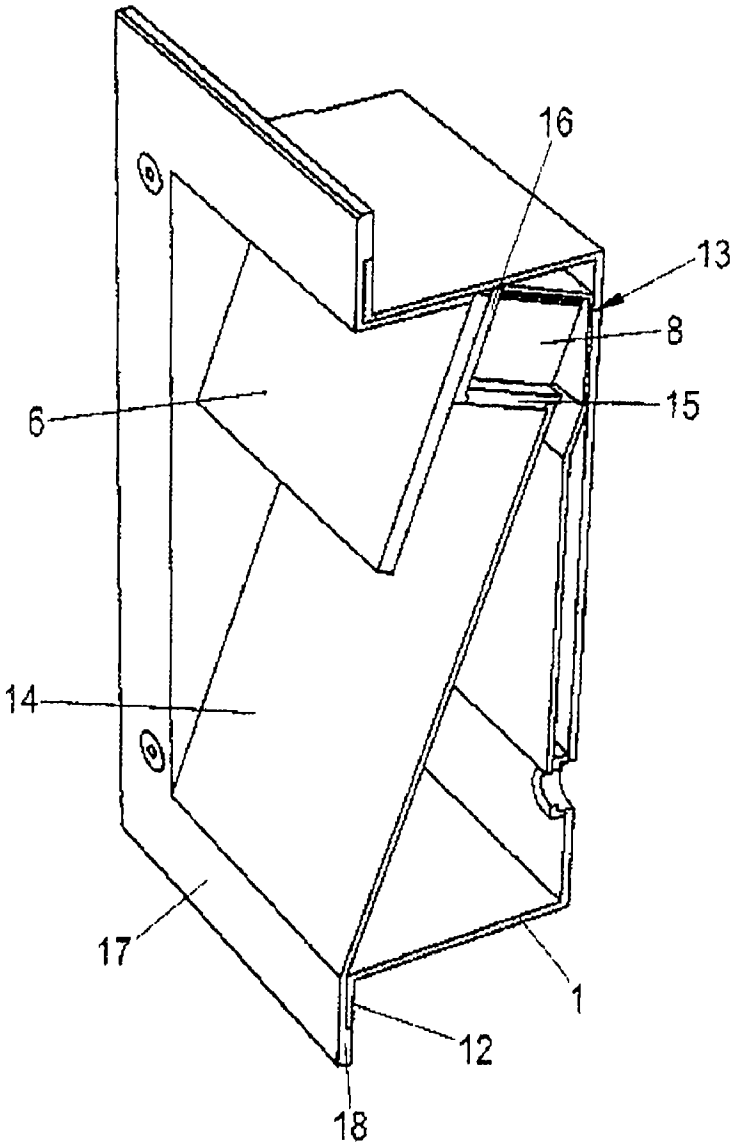
FIG. 5 is a schematic, perspective sectional view of an embodiment of the invention in the form of a built-in lamp.

FIG. 5 shows the basic concept of an embodiment of the invention which is made in the form of a built-in wall luminaire or ceiling luminaire.

In this embodiment, a housing 1 is used in the form of a rectangular built-in pot with outwardly disposed abutment flanges 12. In this housing 1, a light conducting wall 14 is provided which extends over the housing width and which extends from an upper corner region 13 at the rear wall side to the abutment flange 12 disposed diagonally opposite this corner region; i.e. it extends slantingly through the housing. The end 18 of the light conducting wall at the opening side is preferably fixed by clamping between the associated abutment surface 12 and a cover frame 17 which surrounds the housing opening.

The end region of the light conducting wall 14 at the rear wall side is preferably angled twice and preferably at right angles in each case so that a first angled portion 15 can serve as a carrier for the light source 8. The light beam generated by the light source 8 enters via a corresponding cut-out in the angled portion into the region between the light conducting wall 14 and the lighting surface 16.

A second angled portion 16 following the first angled portion 15 extends parallel to the light conducting wall 14 and serves as a contact and fastening surface for the lighting surface 6. This lighting surface 6 comprises light permeable material, in particular opal glass or a corresponding plastic material, and it likewise extends over the housing width and to the front up to and approximately into the region of the opening plane of the luminaire.

A plurality of LED elements with an individual or a common optical focusing system attached to a carrier part can be used as a light source 8, but also a fluorescent lamp arrangement, in particular in the form of a multi-rod compact fluorescent lamp.

Figure 6:
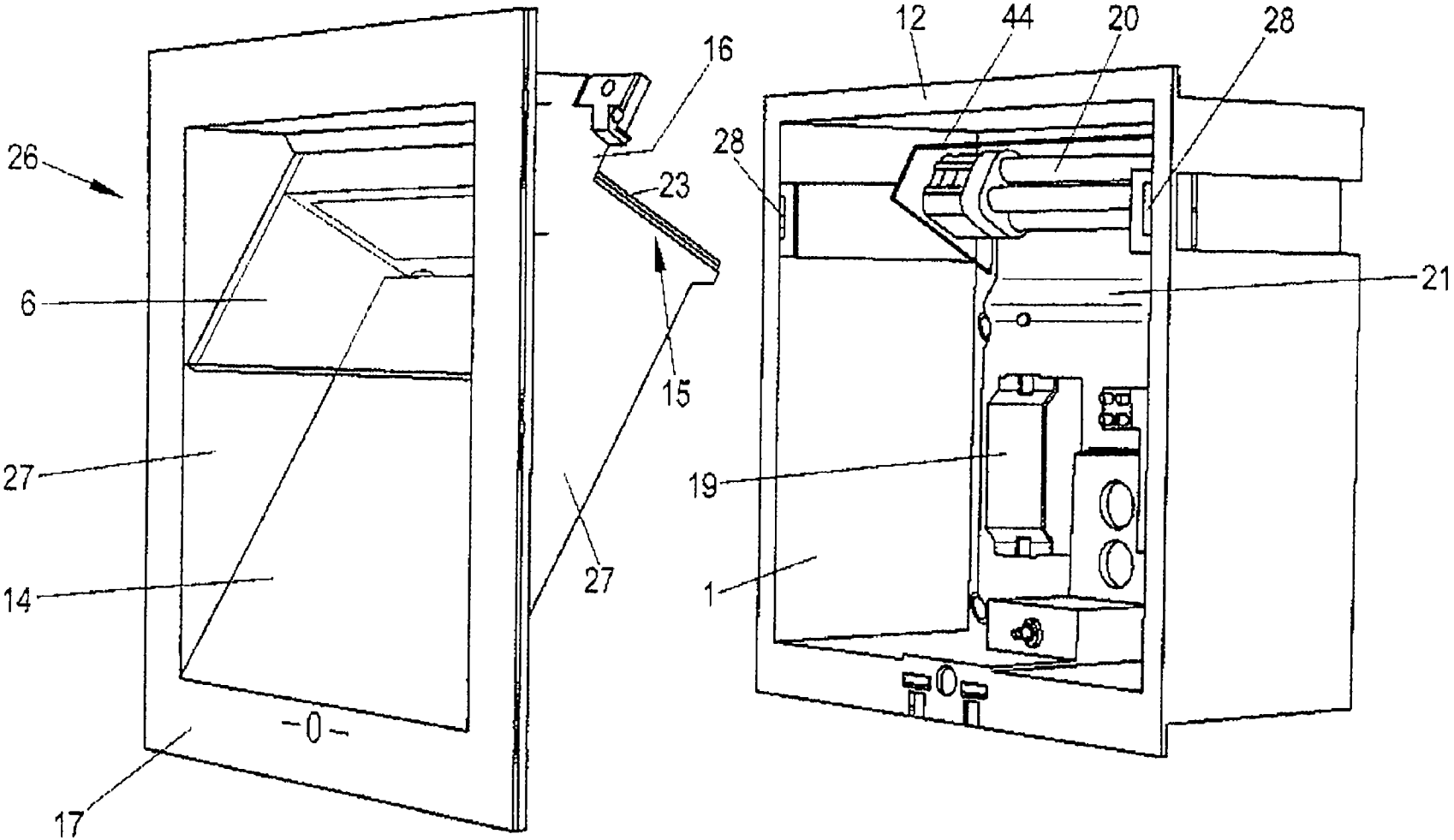
FIG. 6 is a perspective representation of a preferred embodiment of the invention comprising two assemblies which can be coupled with one another.

The perspective representation in accordance with FIG. 6 shows a particularly advantageous practice orientated embodiment of the invention, with in this case the luminaire comprising two assemblies which can be pushed into one another and can be mutually latched. One of these two assemblies is formed by the housing 1 which is made in the manner of a rectangular pot, which has a peripheral flange-like abutment surface 12 at the opening side and which carries a mounting plate 21 at the rear wall side to which the electrical and electronic components such as ballast 19, connection terminals and the like are fastened. The mounting plate is made in the upper corner region of the housing 1 in the embodiment shown as a carrier for a fitting of a compact fluorescent tube 20. Instead of a fluorescent lamp, a carrier system for a plurality of LEDS can also be connected to the fastening plate 21.

In the upper part of the housing 1, inwardly extending appendages with housing slots 28 are provided in the plane of the abutment surface 12.

Figure 7:
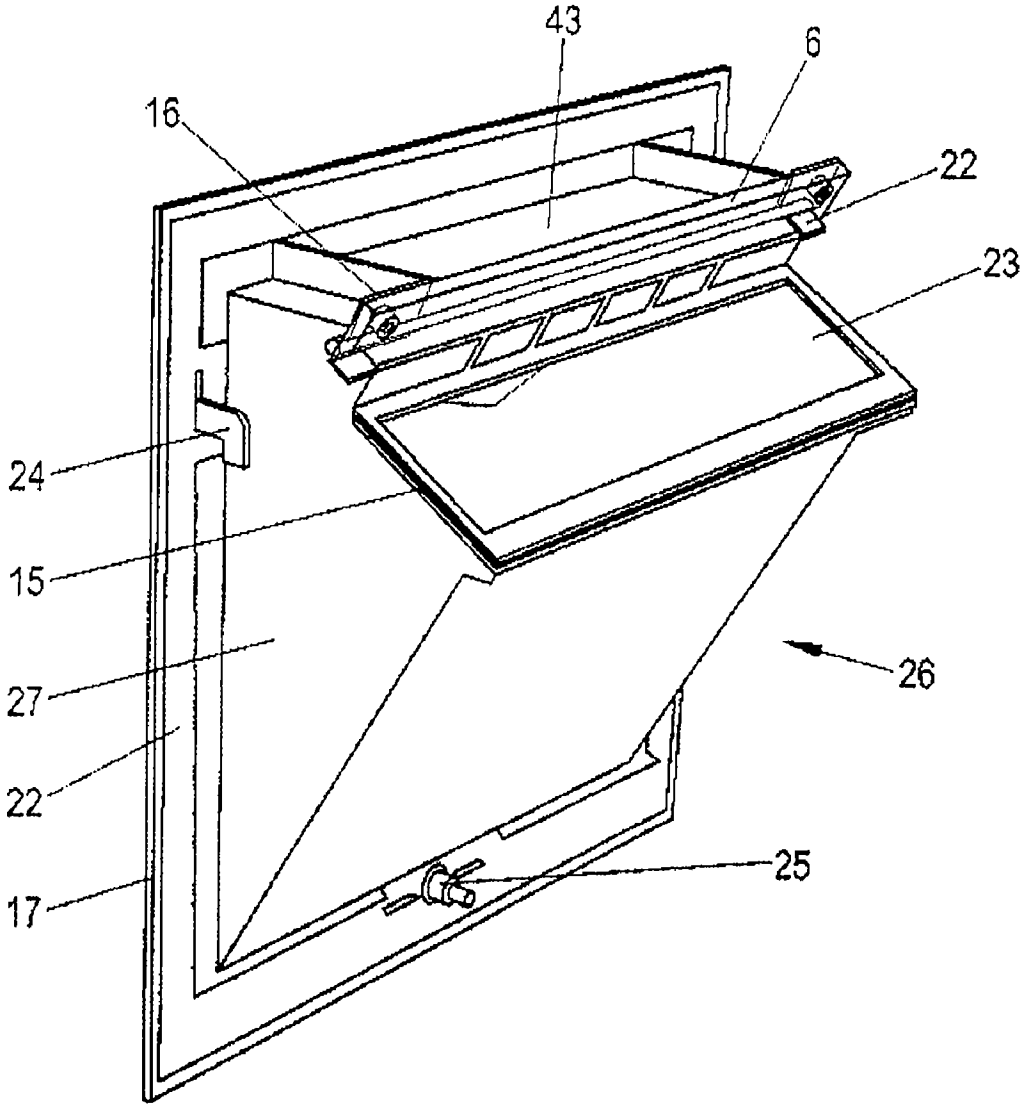
FIG. 7 is a rear side view of the unit in accordance with FIG. 6 which can be pushed into the housing.

The assembly 26 can be pushed into this housing 1 including the light source and the required electrical components, with the abutment surface 12 of the housing 1 and the cover frame 17 of the assembly 26 contacting one another areally in the inserted state with the interposition of a seal 22 to be seen in FIG. 7 and being able to be firmly clamped to one another via hooks 24 which are provided at the cover frame 27 and which engage into the housing slots 28 and via an eccentric or conical closure 25.

In the joined together state of the housing 1 and the assembly 26, the lighting unit 20 is positioned with respect to a light permeable and sealingly attached plate 23 of the assembly 26 such that the light emitted by the lighting unit 20 can enter into the space between the light conducting wall 14 and the lighting surface 6 of the assembly 26.

The assembly 26 is made as a unit closed on itself; i.e. its inner space receiving the lighting surface 6 is bounded by the obliquely extending light conducting wall 14, by the side walls 27, by a glass cover at the opening side and also by a top wall 29 and the light permeable plate 23 disposed opposite the light source 20.

FIG. 7 showing the assembly 26 in a rear side view allows details of the described structure to be recognized and also shows the seal 22 which is effective between the cover frame 17 and the abutment surface 12 of the housing 1 as well as the hooks 24 which cooperate with the housing slots 28 and which ensure, together with an eccentric or conical closure 25, a releasable, but simultaneously stable and sealing, connection between both assemblies.

The panel forming the lighting surface 6 is screwed to the angled surface 16 with interposition of a seal.

An ideal inner space ventilation with a corresponding exchange of moisture is ensured by the design of the luminaire in the form of two couplable assemblies so that no disturbing condensed water arises.

REFERENCE NUMERAL LIST

1 housing
2 top wall
3 base wall
4 end-face wall
5 light exit opening, top
6 lighting surface
7 carrier surface
8 LED elements
9 light exit opening, bottom
10 mark
11 visible surface
12 abutment surface
13 corner region
14 light conducting wall
15 first angled portion
16 second angled portion
17 cover frame
18 end of the light conducting wall at the opening side
19 ballast
20 fluorescent lamp
21 mounting plate
22 seal
23 light permeable plate
24 hook
25 eccentric closure
26 assembly
27 side walls
28 housing slot
29 mounting surface
30 base plate
31 U-section part
32 support wall parts
33 mounting
34 holding hoop
35 cover
36 seal
37 flange part
38 masking cap
39 latch element
40 elongate hole
41 connection terminal
42 plug
43 top wall
44 wall section

The invention claimed is:

1. A wall luminaire for mounting on an existing wall, the luminaire having a housing intended for the reception of electrical components and having at least one light permeable element mounted to the housing, wherein the housing has a parallelepiped shape with a rectangular top wall, a rectangular base wall and end-face walls;

at least one light exit opening is provided at least in the top wall or in the base wall and a planar lighting surface is provided which is associated with a front side of the housing, extends parallel to a front wall of the housing and is made of opal glass or of a light-effective plastic material; and a plurality of LED elements are arranged as a light source on at least one carrier surface in an inner space of the housing such that a directed light beam is generated between the existing wall and the lighting surface and, on the one hand, effects a regional illumination at least one of above the top wall or below the base wall and, on the other hand, starting from the respective light exit opening, expands such that each lighting surface is disposed in the sidelight region of the light beam.

2. A wall luminaire in accordance with claim 1, wherein at least one light exit opening, corresponding to the light exit opening at the top side, is provided in the base wall of the housing.

3. A wall luminaire in accordance with claim 2, wherein a respective lighting surface is associated with the upwardly and downwardly directed light sources and the housing is disposed centrally symmetrically between the two identical lighting surfaces.

4. A wall luminaire in accordance with claim 1, wherein a width of each lighting surface is equal to a longitudinal extent of the housing and the housing or a corresponding housing top wall forms a visible surface bounding the respective lighting surface.

5. A wall luminaire in accordance with claim 1, wherein the light exit openings are made circular or elongated.

6. A wall luminaire in accordance with claim 1, wherein, on a side of the housing opposite the planar lighting surface, a surface is fixed to the housing which has reflective and/or scattering properties.

7. A luminaire in accordance with claim 1, wherein the housing includes a base plate for mounting of all functional components, a profile section which is essentially U-shaped in cross-section and has at least one light exit opening and an outwardly disposed mounting surface for a lighting surface as well as lateral support wall parts.

8. A luminaire in accordance with claim 7, wherein a mount for functional components and at least one carrier surface for LED elements with associated optical system is mounted to the base plate.

9. A luminaire in accordance with claim 8, wherein carrier surfaces for the LEDs with associated optical system are fastened to a holding hoop in a manner adjustable with respect to position and inclination via elongate and/or slanted hole connections.

10. A wall luminaire in accordance with claim 8, wherein the mount is shaped from stamped sheet metal parts.

11. A luminaire in accordance with claim 7, wherein the light exit openings formed in the section part are sealingly closed by means of a light permeable cover.

12. A luminaire in accordance with claim 11, wherein the base plate can be connected to the section part via the lateral support wall parts with the interposition of a seal which is made in one part to form an outwardly sealed parallelepiped.

13. A luminaire in accordance with claim 7, wherein the support wall parts which can be screwed to the U-section part at the end-face side can be mounted to the base plate via angled flange parts and have holding elements for latching of lateral masking caps.

14. A wall luminaire in accordance with claim 1, wherein the housing is made as a rectangular built-in pot including an outwardly disposed abutment flange;

wherein a light conducting wall is provided which extends over a housing width and from a corner region, at the rear wall side to the front housing end or abutment flange disposed diagonally opposite the corner region, wherein a planar lighting surface made of one of opal glass or a corresponding plastic material is provided parallel to and spaced apart from the light conducting wall in the housing and extending approximately up to an opening plane of the housing; and wherein the light source is provided in the upper corner region of the housing at the rear wall side which extends over the housing width and generates a directed band-shaped light beam between the light conducting wall and the lighting surface, with both the light conducting wall and the lighting surface being disposed in the sidelight region of the outwardly expanding light beam.

15. A wall luminaire in accordance with claim 14, wherein an optical focusing lens is associated with each LED element.

16. A wall luminaire in accordance with claim 14, wherein an end region of the light conducting wall at the rear wall side merges into a first angled portion which is directed to the opening side of the housing and in which a light entry opening is formed which is covered by a light permeable plate.

17. A wall luminaire in accordance with claim 16, wherein the first angled portion is followed by a second angled portion which is approximately parallel to the light conducting wall and which forms a contact and mounting surface for the lighting surface.

18. A wall luminaire in accordance with claim 14, wherein a metal mounting plate for mounting of the light source and also of all the further electronic functional components is attached to the rear wall of the housing and is made of plastic; and wherein all the components conducting and guiding the light are combined to form an assembly which is adapted to be pushed into the housing and to be connected to the housing.

19. A wall luminaire in accordance with claim 18, wherein the assembly is connectable to the housing having a peripheral flange-like abutment surface via a cover frame formed in one part with the components directing and conducting the light.

20. A wall luminaire in accordance with claim 19, wherein the cover frame is sealingly coupleable to the housing by interposing a seal, by means of hooks engaging into housing slots and by means of an eccentric or conical closure.

21. A wall luminaire in accordance with claim 18, wherein the inner space of the housing is sealed with respect to the light conducting space bounded by the light conducting wall, by side walls and by the light permeable plate of the assembly.

22. A wall luminaire in accordance with claim 1, wherein the light exit opening is a centrally disposed light exit opening.

23. A wall luminaire according to claim 1, wherein the light exit opening is a coaxial light exit opening with an associated light source.

24. A wall luminaire in accordance with claim 1, wherein the end-face walls comprise square walls.

* * * * *